US007161789B2

(12) United States Patent
Robertson

(10) Patent No.: US 7,161,789 B2
(45) Date of Patent: Jan. 9, 2007

(54) ION CHIP

(76) Inventor: Reginald R. Robertson, Apartment 201, 605 River Avenue, Winnipeg, Manitoba (CA) R3H 0Z4

( * ) Notice: Subject to any disclaimer, the term of this patent is extended or adjusted under 35 U.S.C. 154(b) by 213 days.

(21) Appl. No.: 10/855,498

(22) Filed: May 28, 2004

(65) Prior Publication Data

US 2004/0218338 A1 Nov. 4, 2004

Related U.S. Application Data

(63) Continuation-in-part of application No. 09/983,784, filed on Oct. 25, 2001, now abandoned.

(51) Int. Cl.
*H01T 23/00* (2006.01)

(52) U.S. Cl. ..... 361/230; 361/231

(58) Field of Classification Search ..... 361/230, 361/231

See application file for complete search history.

(56) References Cited

U.S. PATENT DOCUMENTS 2,983,847 A * 5/1961 Spengler ..... 250/324
3,671,798 A * 6/1972 Lees ..... 313/336
3,812,559 A * 5/1974 Spindt et al. ..... 445/52
3,873,835 A * 3/1975 Ignatijev ..... 250/324
4,096,544 A * 6/1978 Ignatjev ..... 361/231
4,170,819 A * 10/1979 Peter et al. ..... 29/853
4,272,699 A * 6/1981 Faubel et al. ..... 313/360.1
4,502,091 A * 2/1985 Saurenman ..... 361/213
4,771,361 A * 9/1988 Varga ..... 361/231
5,034,651 A 7/1991 Domschat
5,065,272 A * 11/1991 Owen et al. ..... 361/231
5,141,529 A 8/1992 Oakley et al.
5,296,019 A * 3/1994 Oakley et al. ..... 96/95
5,792,243 A * 8/1998 Meffert et al. ..... 96/83
6,002,573 A * 12/1999 Partridge ..... 361/231
6,077,334 A * 6/2000 Joannou ..... 96/66
6,176,977 B1 * 1/2001 Taylor et al. ..... 204/176

FOREIGN PATENT DOCUMENTS

GB 2090547 A 7/1982

* cited by examiner

*Primary Examiner*—Chau N. Nguyen
*Assistant Examiner*—Scott Bauer

(57) ABSTRACT

The ion chip has an ionizing structure in intimate electrical and physical contact with a conductor. The ionizing structure is either a carbon fiber layer or ionizing needles or both. The conductor may be a bare metal wire, a metal plate or a metal layer on a base insulation layer. A high voltage unipolar generator, usually negative, but possibly positive, supplies voltage to conductor and ionizing structure to generate ions. Guide strips confine, contain and protect the ionizing structure within a channel in which the ionizing structure is recessed. The metal layer can extend beyond the guide strips to provide electrostatic focussing power. Alternatively a distinct metal layer outside the channel and separated from the conductor and the ionizing structure by interruption blocks on the surface of the base insulation layer, is charged to greater voltage to provide greater focussing power. Typically the ion chip generates negative ions for air purification. It can also be used to generate positive ions or ozone.

20 Claims, 7 Drawing Sheets

ION CHIP

This application is a continuation in part of application Ser. No. 09/983,784, filed 25 Oct. 2001 now abandoned.

This invention is related to air cleaning, conditioning, freshening and purifying by generating negatively charged atmospheric ions. Specifically the application is directed to an ion chip, which generates negative atmospheric ions.

This application is directed to an ion chip which has an outer ionising structure lying along and in electrical contact with a conductive surface, either a thin conductive plate or an intermediate conductive layer attached to an inner insulating layer. A high voltage generator has its negative unipolar electrode attached to the conductive layer. In use the ionising structure generates corona discharge, which ionises air molecules to negative ions. As would be obvious to those skilled in the art, a high voltage generator attached by a positive unipolar electrode to the conductive layer would generate positive ions. The ion chip can also be used to generate ozone at suitable negative voltages. The conductive surface in use is at the same high negative voltage as the ionising electrodes, creating a repulsing electrostatic field producing a directional stream of negative ions.

Although the invention is described and referred to specifically as it relates to specific ionising structure conductive surface combinations for generating atmospheric ions, it will be understood that the principles of this invention are equally applicable to similar ionising structure conductive surface combinations and accordingly, it will be understood that the invention is not limited to such ionising structure conductive surface combinations for generating atmospheric ions.

BACKGROUND

Negatively charged atmospheric ions remove air borne contaminants by precipitation. Also presence of negatively charged ions is believed beneficial to health, as compared to positively charged ions. Systematic indoor generation of negatively charged ions, which improve indoor air quality, not only neutralizes and precipitates positively charged ions and contaminants, which fall to the floor or ground, but provides beneficial negative ions. By removing air borne contaminants and providing (an excess of) negatively charged ions, air quality within a sealed environment, such as a modern air conditioned building, which minimises external air exchange, can be significantly improved. Air borne contaminants are typically positively charged dust or bacteria or viruses, whose electric charge assists in their suspension in the air. These air borne contaminants accumulate with time, unless removed. Airborne bacteria and viruses are a major problem causing infection in hospitals, their removal would obviously be beneficial. A supply of negatively charged ions neutralizes their charges and precipitates the contaminants from the air. The net effect would be to cure or alleviate or ameliorate the "sick building syndrome."

When negative ions are introduced into ventilation airflows air borne contaminants are precipitated to the ground as dust or smaller particles and can be removed by routine housekeeping. The energy consumption of an ion chip is minuscule, negligible compared to electric lighting. The ion chip can be fitted or retrofitted into existing air ventilation systems without difficulty. It can also be used to cleanse static ambient air.

PRIOR ART

Generally negative ions are generated by passing air through an inlet air filter, a small variable speed fan, an electronic high voltage ion generator associated with an ioniser (carbon fiber strand or other ionising needle) which creates ions by electrical stress corona. A typical drawback is dust build up in the unit, and reduced output from the same dust build up, demanding considerable maintenance. Another drawback is ozone generation, which may transgress FDA requirements, and cause debate for health reasons. Also ion distribution by the fan is itself often unsatisfactory. The fan noise itself is often considered objectionable, as well.

One solution is to provide negative ionisers, at ceiling height in the path of incoming airflows from existing air-conditioning systems. Applicant is coinventor of two earlier U.S. Pat. No. 5,141,529, issued 25 Aug. 1992, and U.S. Pat. No. 5,296,019, issued 22 Mar. 1994, both to Oakley and Robertson. Neither of these was satisfactory because the exposed conductive carbon fibers (which are in fact carbon coated thread fibers) of the ioniser were too easily damaged during use and handling. The corona discharge also damages the conductive fibers, by depositing material, which then require brushing or cleaning, which further damages the conductive fibers. U.S. Pat. No. 5,141,529 teaches an ioniser consisting of aligned sections of continuous conductive fiber at a high negative voltage outside an insulator tube. The sections may be flat against the insulator surface or form loops projecting therefrom, optionally with fiber spikes extending outward from the conductive fiber. U.S. Pat. No. 5,296,019 teaches in addition an ioniser with paired conductors of conductive fibers running along and spaced apart from the insulator tube by supports. A third metal conductor runs through the insulator tube connected at its ends to the ends of the paired conductive fiber conductors, which may contact each other at the supports. Holes in the insulator tube allow air to be blown into it and flow out past the paired conductive fiber conductors. Another ioniser is a insulator tube with a embedded foil layer of circular cylindrical shape with a number of pins or needles passing through the outer insulator tube to contact the foil, optionally conductive fiber loops are placed at the ends of the needles. Openings in the insulator tube allow air to be blown into it and out past the needles. Various arrays of ionisers for effective air cleaning are taught. The third insulated metal wire conductor's, of FIGS. 9, 11 and 12 of U.S. Pat. No. 5,296,019, function was to prevent or reduce capacitate discharge from an ioniser with a fault or break in it, which is required to eliminate, prevent or reduce cold sparking.

The devices of the patents have three defects. The insulated electrical supply (wire) to the ionising conductors, generated a static field effect, because of the high voltage involved, which could weaken, distort, or cut off ionising emissions (negative ion stream) from the ionisers, depending on the distance and position of supply cable to ioniser. When the ionisers are in series any faulty supply circuit interruption including faults in the ioniser strands could produce a high capacitive discharge, nullifying precautions to avoid cold sparking. Lastly the ionisers radiate negative ion flow outward in all directions without providing a directed focussed stream.

OBJECTS OF THE INVENTION

It is a principal object of the invention to provide an ion chip having an ionising structure in contact with a metal conductor, surface, or layer, which when supplied by a high voltage generator the ionising structure generates ions, and the metal conductor surface or layer provides a repulsing electrostatic field to direct and focus the ion stream. It is a subsidiary object of the invention to provide a base insulation layer to support the metal conductor, surface or layer. It is a further subsidiary object of the invention to extend the metal surface, conductor or layer around the ionising structure so that the repulsing electrostatic field extends beside the ionising structure to better direct and focus the ion stream. It is a further subsidiary object to provide a separate metal surface, conductor or layer surrounding the ionising structure so that it may be at a higher voltage than the ionising structure, and its separate repulsing electrostatic field extends beside the ionising structure to better direct and focus the ion stream. It is a further subsidiary object of the invention to provide insulating walls, which may be parallel or circular, to protect said ionising structure. It is a further subsidiary object of the invention to recess the ionising structure within said walls to protect it. It is a further subsidiary object of the invention that the ionising structure be selected from the group consisting of conductive carbon fibers, ionising needles and mixtures thereof. It is a further principal object to provide ion chips to generate directed and focussed negative ion streams forming ion showers and ion curtains to precipitate contaminants from ambient air without the use of air filters.

DESCRIPTION OF THE INVENTION

In one broad aspect the invention is directed to an ion chip with an ionising structure having a plurality of corona forming ionising electrodes, in electrical and physical contact with the surface of a conductor. When sufficient high voltage is applied to the conductor by a high voltage generator the ionising structure generates ions. The conductor has a repulsing electrostatic field which intensifies, directs and focusses the negative ion stream from the ionising structure. Preferably the ionising structure is selected from the group consisting of conductive fibers, ionising needles and mixtures thereof and the conductor is metal. More preferably the ionising structure is conductive carbon fibers and the conductor is a bare uninsulated wire. Preferably the conductor lies in a channel having opposed side walls and a back wall, along the back wall. The conductive carbon fibers extend forward away from conductor and back wall, filling the space between the side walls, and are recessed within the channel. Preferably the channel is circular and the conductor is a ring conductor. This ion chip produces a directed, focussed stream of negative ions.

In a second broad aspect the invention is directed to an ion chip comprising a conductive surface having attached thereto an ionising structure, having a plurality of corona forming ionising electrodes, in electrical and physical contact with the conductive surface. When sufficient high voltage is applied to the conductive surface by a high voltage generator, the ionising structure generates ions. The electrostatic field of the conductive surface intensifies, directs and focusses the negative ion stream from the ionising structure. Preferably the ionising structure is selected from the group consisting conductive carbon fibers, ionising needles and mixtures thereof, and the conductive surface is metal. Usually the ionising structure is conductive carbon fibers, sometimes supported by pins attached to the metal surface, sometimes additionally comprising ionising needles received in the metal surface in metal sockets. Sometimes the ionising structure comprises ionising needles received in the metal surface in metal sockets, alone.

In a third broad aspect invention is directed to an ion chip comprising a conductive layer on a base insulation layer. The conductive layer has attached thereto an ionising structure, having a plurality of corona forming ionising electrodes, in electrical and physical contact with the conductive surface, whereby when sufficient high voltage is applied to said conductor by a high voltage generator said ionising structure generates ions. Preferably the ionising structure is selected from the group consisting conductive carbon fibers, ionising needles and mixtures thereof, and the conductive layer is metal. More preferably the ionising structure is conductive carbon fibers, and the metal layer is a printed circuit. Sometimes the ionising structure additionally comprises ionising needles received in the metal surface in metal sockets. Sometimes the ionising structure comprises ionising needles received in the metal surface in metal sockets, alone. Preferably both metal layer and base insulation layer extend beyond the ionising structure, to provide additional directing and focussing by its electrostatic field. More preferably the ionising structure extends along a channel between paired opposed parallel insulating guide strips. The ionising structure is recessed within the channel, and the metal layer extends outside said channel on said the insulation layer. The ion chip may have two conductive metal layers, a first in contact with the ionising structure and a second at least partly surrounding the first and separated from contact with the first metal layer and the ionising structure by interruption blocks on the surface of said base insulation layer. Preferably the ionising structure extends along a channel between paired opposed parallel insulating guide strips. The ionising structure is recessed within said channel. While the said first metal layer extends inside the channel and the second metal layer extends outside the channel and is separated from contact with the first metal layer and the ionising structure by interruption blocks on the surface of the base insulation layer. The ion chip may comprise conductive carbon fibers and at least one ionising needle received in said metal surface in a metal socket embedded in the base insulation layer. Both metal layer and base insulation layer extend beyond the ionising structure, which is confined within an insulating tubular wall. There may be a first conductive metal layer in contact with the ionising structure, while a second metal conductive layer at least partly surrounds the first metal layer outside the insulating tubular wall. The second conductive metal layer is separated from contact with the first metal layer and the ionising structure by interruption blocks on the surface of the base insulation layer.

The invention is applicable to improving indoor air quality by reducing air borne contaminants. It is not a panacea for faulty designed air conditioning, or very heavy dust conditions. It is suitable for maintenance of normal industrial clean room protocols. Generally the most difficult situation is encountered immediately after installation of the ion chip system, when there is typically a high concentration of suspended particles in the air, some of which settle by normal gravitation, some of which are virtually permanently suspended. There are also variations of temperature, humidity, ventilation, and work, human and animal activity. Nevertheless application of the ion chip system should purge the air of airborne pollutants to a reasonable minimum equilibrium level within twenty-four to forty-eight hours of operation—depending on strength and distribution of negative ions and the amount of air borne pollutants and their level of generation. After the initial purge period the ion chip system can be maintained to provide an appropriate level of negative ions. This appropriate level precipitates air borne pollutants generated by work, human and animal activity almost at once, which will remain precipitated as long as the system is energised, and will be collected by routine housekeeping. The level of negative ions must not only precipitate bacteria and pathogenic microbes, which if not rendered harmless by precipitation, must inhibit their growth in the precipitated residue. An excess of atmospheric negative ions should be present, as this is generally beneficial as opposed to positive ions, which are not.

The ion chip system is applicable to controlling static and air borne dust by precipitation in the manufacturing finishing operations in the hygiene paper, plastic, automotive, glass and photographic industries as well as automotive industry suppliers. It is also applicable to controlling air borne contamination, known to be fine dust particles and harmful bacteria, in the food preparation and packaging industries, as well as the confinement, rearing and care of livestock (pigs, poultry, pigeons, and horses). It is also applicable to dental and medical institutions affected by air borne transmittal of harmful pathogenic microbes resistant to antibiotics. It is also applicable to administrative offices, supervisory stations, transportation facilities, and other heavily staffed and occupied areas, where computer generated positive ions contribute to poor air quality. Similarly it can be applied to bars, fast food outlets, restaurants, affected by smoke and air borne infection.

It is known from prior art use of negative ion streams in dentists offices, that:

reductions of mass of respirable particles in $\mu g/m^3$ were observed from 7±3 to 5±2, from 8±4 to 5±2, from 8±4 to 5±2, and 23±17 to 12±4;

reductions of total microbials/$m^3$ from 225±75 to 20±10, 525±25 to 80±20, 525±25 to 145±15, 400±117 to 95±18;

reductions of airborne streptococci/$m^3$ from 200±67 to 30±10, 550±50 to 60±10, 550±50 to 120±10, 325±92 to 85±15 reductions of airborne staphylocci/$m^3$ from 75±25 to 20±10, 225+8 to 35±5, 225±8 to 60±10, 150±33 to 70±23 reductions of airborne yeasts and moulds/$m^3$ from 55±12, 140±7, 140±7, 150±50 to 0 in every case. These reductions were considered highly significant.

As noted above it can be fitted or retrofitted into existing ventilation systems, with no or minimal difficulty.

As noted below, the ion chip under nonstandard controlled operating conditions can be used to generate ozone for periodic fumigation in the absence of humans and animals.

In general the ion chip is installed in or on the ceiling (at 8 to 10 feet, 2½ to 3 meters) with its ionising structure downwards and generates a downward stream of negative ions (directional and focussed). One or more commonly several ion chips is located over a source of pollution so the negative ions will intercept and precipitate air borne contaminants immediately to contain spread. Alternatively they may be located at the inlet or outlets of an air conditioning system. One or more lines of adjacent ion chips can be used to form a negative ion shower or curtain to prevent the passage of air borne contaminants where a permanent barrier is not feasible. Ion chips can be installed inside existing ventilation ducts to inject negative ions into the air flow. In this respect the ion chip may be directly associated with a fan to direct both air and ion stream. Related is an ion chip arrangement to intercept and precipitate dust, dirt and other contaminants blown off a product, replacing clean tunnels in automotive paint and coating plants. Ion chips can be mounted on a rotational device to sweep a fixed zone, means to wipe clean the ionising structure may be included. Routine experimentation can be used to determine the most appropriate ion chip arrangement.

The high voltage supply is preferably generated by an electronic ion generator which comprises a printed circuit board housed in a strong insulated box, with a uni-polar negative output, with full wave rectification and a miniature step-up instrument transformer of limited short circuit capacity to ensure minimum ignition energy cold sparking under fault and limited threshold CD value of about 7 kV to ensure limited ozone considerably within the EDA recommendation of 50 parts per billion.

DESCRIPTION OF THE PREFERRED EMBODIMENTS

Figure 1:
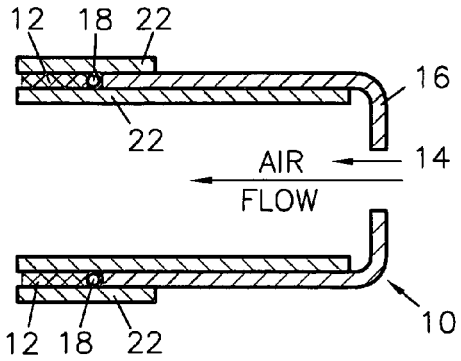
FIG. 1 shows a side cross sectional view of a prototype precursor of an ion chip of the invention.
Figure 2:
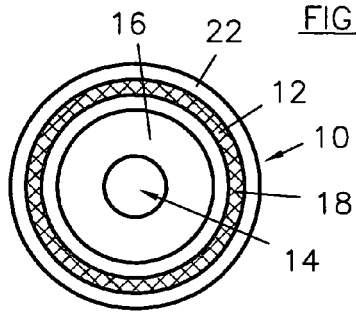
FIG. 2 shows a front elevational view of the precursor of FIG. 1.

FIGS. 1 and 2 show a prototype of a precursor of an ion chip of the invention. Numeral 10 indicates an ionising blow-off device to remove static without subjecting ionising layer 12 of fragile conductive carbon coated fiber yarn ionising filament to direct impingement and prospective early deterioration by compressed air. Compressed air is fed through aperture 14 of insulating sleeve 16, ionising layer 12 emits negative ions into the air flow. Ionising layer 12 is in full contact along its entire length with bare uninsulated copper wire 18 forming a live conductor ring, connected directly to a high voltage generator. Ionising layer 12 and copper wire 18 are supported by inner 20 and outer 22 insulation rings and middle insulation sleeve 16. Ionising layer 12 is ambushed (recessed) to avoid wear from compressed air. Prototype precursor 10 was found to overcome several previous problems. The fragile carbon fiber of ionising layer 12 was contained, supported, protected and recessed by the semi-enclosure provided by insulation sleeve 16 and rings 20 and 22, wear was reduced, while neither recessing nor semi-enclosure materially affected (reduced) negative ion output from ionising layer 12. The complete surface to surface contact between ionising layer 12 and live conductor ring 18, eliminated the effects of breaks and faults in the carbon coated fiber yarn. Ionising layer 12 was supplied with electricity regardless of breaks and faults, electrostatic capacitive discharge causing cold sparking minimum ignition level was reduced to a minimum due to electrical contact with live conductor ring 18 along the whole length of ionising layer 12. Also for the same reason progressive sequential replacement of thread end electrodes maintained a steady level of output emissions of negative ions. Finally the negative ion emissions formed a stream essentially perpendicular to the ionising layer, caused by the repulsing and focussing electrostatic field of live conductor ring 18, which directs, focusses, and intensifies the negative ion stream.

Figure 3:
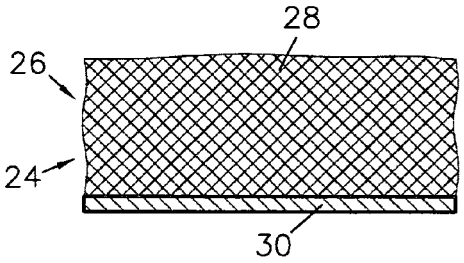
FIG. 3 shows a cross sectional elevational view of an ion chip of the invention.

In FIG. 3, numeral 24 indicates an ion chip of the invention which has ionising structure 26 composed of a conductive, filamentous or fibrous layer 28 in firm physical and electrical contact with conductive layer 30, which may be a thin metal layer, foil or support plate. In FIG. 3, layer 28 is typically a loosely plaited continuous conductive carbon coated fiber yarn or strand of textile coated about 1 inch (2½ cm) diameter, preferably comprising conductive copper thread to reinforce, stabilize, and ensure electrical contact. The carbon fiber yarn or strand of layer 28 has a multiplicity of surface exposed thread ends, known to act as self renewing ionising electrodes when connected to a sufficiently high negative voltage. These ionising electrodes through corona discharge create a stream of negative ions, essentially ozone free. As the initial group of dominant ionising electrodes cease to function due erosion of electrodes from ionisation, others will start functioning to replace them, guaranteeing a steady flow of ions until all available thread ends are exhausted, in about a year. Dominant (active) ionising electrodes are those with greater sharpness of profile compared with suppressed (inactive) ionising electrodes. Electrically full surface contact between structure 26 and conductive layer 30 eliminates difficulties of electrical connection. Contact cement or similar adhesive as known to those skilled in the art is used to ensure this contact. The precise nature of layer 28 is not critical it could for example be a tape composed of conductive fibers or filaments, the hairier (more fibrous or filamentous) the better. Other conductive fibers can be used instead, when they have sufficient ionising electrodes as would be understood by those skilled in the art.

Figure 4:
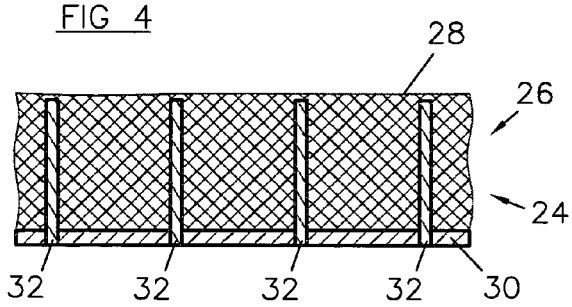
FIG. 4 shows a cross sectional elevational view of another ion chip of the invention.

In FIG. 4, in ion chip 24, ionising structure 26 and conductive layer 30 are as in FIG. 3, except that layer 28 is physically supported and held in place by support pins or props 32, which pass through or are embedded in conductive layer 30.

Figure 5:
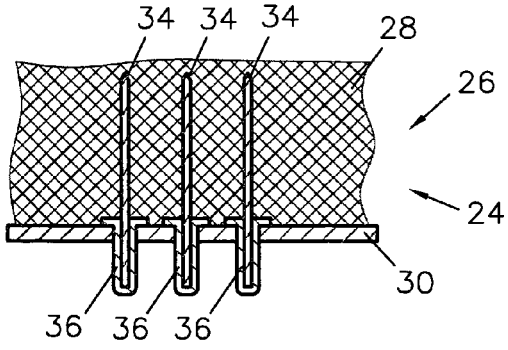
FIG. 5 shows a cross sectional elevational view of a third ion chip of the invention.

In FIG. 5, in ion chip 24, ionising structure 26 and conductive layer 28 are as in FIG. 3, except that layer 28 is physically supported and held in place by ionising needles or pins 34, usually and preferably metal which are typically received in metal sockets 36 in conductive layer 30.

Figure 6:
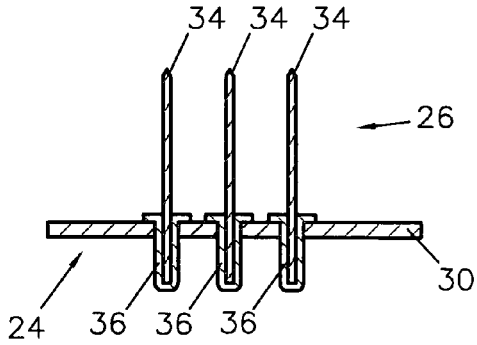
FIG. 6 shows a cross sectional elevational view of a fourth ion chip of the invention.

In FIG. 6, in ion chip 24, ionising structure 26 consists of ionising needles or pins 34, received in metal sockets 36 in conductive layer 30.

In practice ionising structure 26 can consist of conductive fibers, preferably conductive carbon coated textile fibers forming a strand or cable or tape, or ionising needles or both. Both is preferred because ionising needles not only support the conductive fibers, but provide additional ionising electrodes. In any event exhausted conductive fibers 28, and exhausted ionising needles 34, can be separately removed and replaced. In general conductive layer 30 rests on or attaches to a nonspecific nonconductive substrate, such as ceiling, floor, panel, partition or wall, which itself is not part of the invention, conductive layer 30 can also be a thin metal plate.

Figure 7:
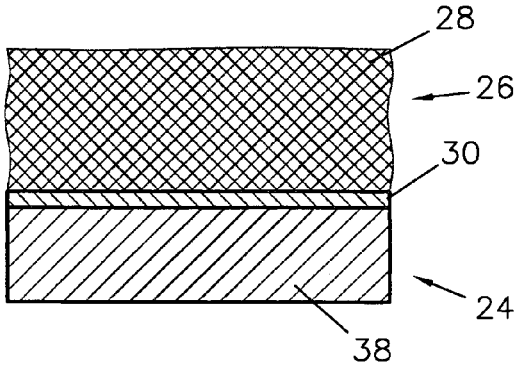
FIG. 7 shows a cross sectional elevational view of a fifth ion chip of the invention.

In FIG. 7, in ion chip 24, conductive layer 30 is more conveniently attached to base insulation layer 38, which allows conductive layer 30 to be a thin metallic deposition, optionally of the printed circuit type. Ionising structure 26 is filamentous or fibrous layer 28, which is fragile and easily damaged, and base insulation layer 38 provides support.

Figure 8:
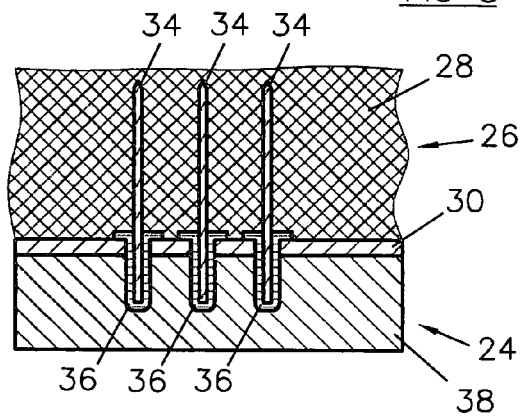
FIG. 8 shows a cross sectional elevational view of a sixth ion chip of the invention.

In FIG. 8, in ion chip 24, ionising structure 26, fibrous layer 28, conductive layer 30 and base insulation layer 38 are as in FIG. 7, except that layer 28 is physically supported and held in place by ionising needles or pins 34, usually and preferably metal which are typically received in metal sockets 36 in contact with conductive layer 30, embedded in base insulation layer 38.

Figure 9:
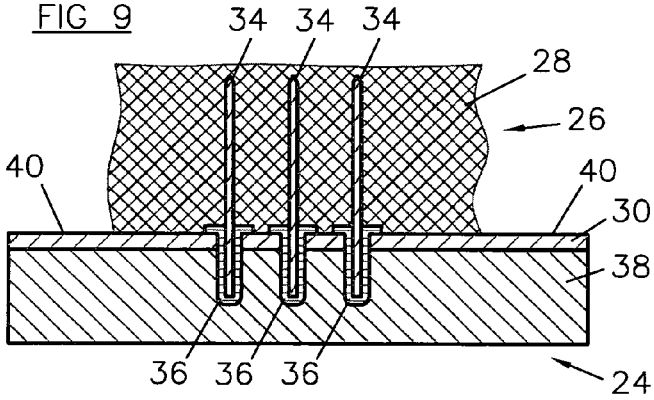
FIG. 9 shows a cross sectional elevational view of a seventh ion chip of the invention.
Figure 10:
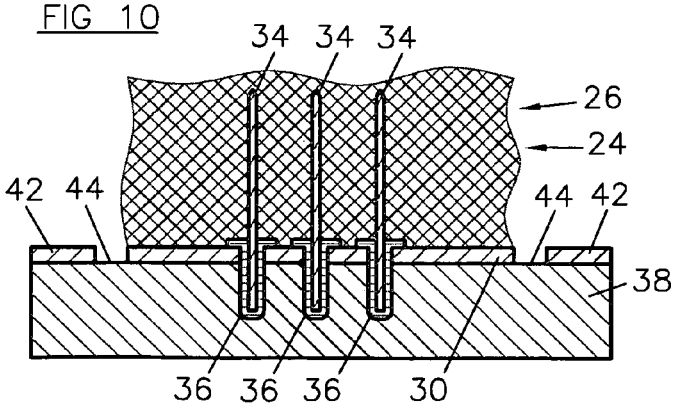
FIG. 10 shows a cross sectional elevational view of an eighth ion chip of the invention.

In FIG. 9, in ion chip 24, ionising structure 26 and fibrous layer 28 are as in FIG. 8, while base insulation layer 38 extends outward of ionising structure 26, as does conductive layer 30 into exposed areas 40. In operation exposed areas 40 are at the same high negative voltage as the rest of conductive layer 30, which extends the repulsing negative electrostatic field on either side of ionising structure 26. The extended repulsing field not only directs the negative ion stream outward better, but noticeably focusses the stream generally perpendicular to conductive layer 30, it also protects the ion chip from electrostatic fields of adjacent grounded and charged conductors In FIG. 10, in ion chip 24, ionising structure 26 and fibrous layer 28 are as in FIG. 8, while base insulation layer 38 extends outward of ionising structure 26, conductive layer 30 is restricted to physical and electrical contact with ionising structure 26. Distinct conductive layer 42 otherwise identical to conductive layer 30 is separated electrically and physically by interruption blocks 44. In operation conductive layer 42 is at a greater high negative voltage (HV2) from conductive layer 30 at high negative voltage (HV1), which extends and intensifies the repulsing negative electrostatic field on either side of ionising structure 30. Distinct conductive layer 42 also protects the ion chip from electrostatic fields generated by adjacent grounded and charged conductors. The combined repulsing electrostatic field (HV1 and HV2) not only directs the negative ion stream outward better than HV1 alone, but focusses the stream better than HV1 alone.

Conductive layer 30 provides firm electrical contact and thus steady ionising voltage to ionising structure 26, especially when this comprises carbon fiber layer 28, also being continuous it prevents capacitive build up and discharge of electrostatic charge in layer 28, it also provides a repulsing electrostatic field for the negative ion stream from ionising structure 26, which directs the negative ion stream radiating from ionising structure 26, essentially perpendicular to conductive layer 30, and finally shields the ion chip from the effects of adjacent grounded and charged conductors. Conductive layer 30 is extremely thin but is shown thicker to be visible in the Figures, it carries little current (μamps) but much voltage (kV). Conductive layer 30 may be a printed circuit layer, another thin metallic deposit, metal foil, or a thin metal plate, providing physical support to ionising structure 26. At high negative voltage conductive layer 30 triggers and maintains the generation of negative ions by ionising structure 26. Printed circuits are well known to those skilled in the art, and have both design flexibility and economy of manufacture. Both conductive metal deposits and thin metal plates are well known to those skilled in the art.

Base insulation layer 38 is a high dielectric material, able to withstand the high operating voltage, typically 7 to 8 kilovolts, without breakdown or tracking, and suitable for metallic deposition of metal layer 30 of the printed circuit type.

In operation the active ionising electrodes form corona plasma stress cones, suppressing other neighboring electrodes in ionising structure 26. The diameter of these cones is thought to be about ½ inch (1¼ cm). The complete surface to surface electrical contact of layer 28 and conductive layer 30, ensures progressive sequential replacement of thread end electrodes to maintain the negative ion stream. When present ionising needles 34 are spaced about ½ inch (1½ cm) apart.

Figure 11:
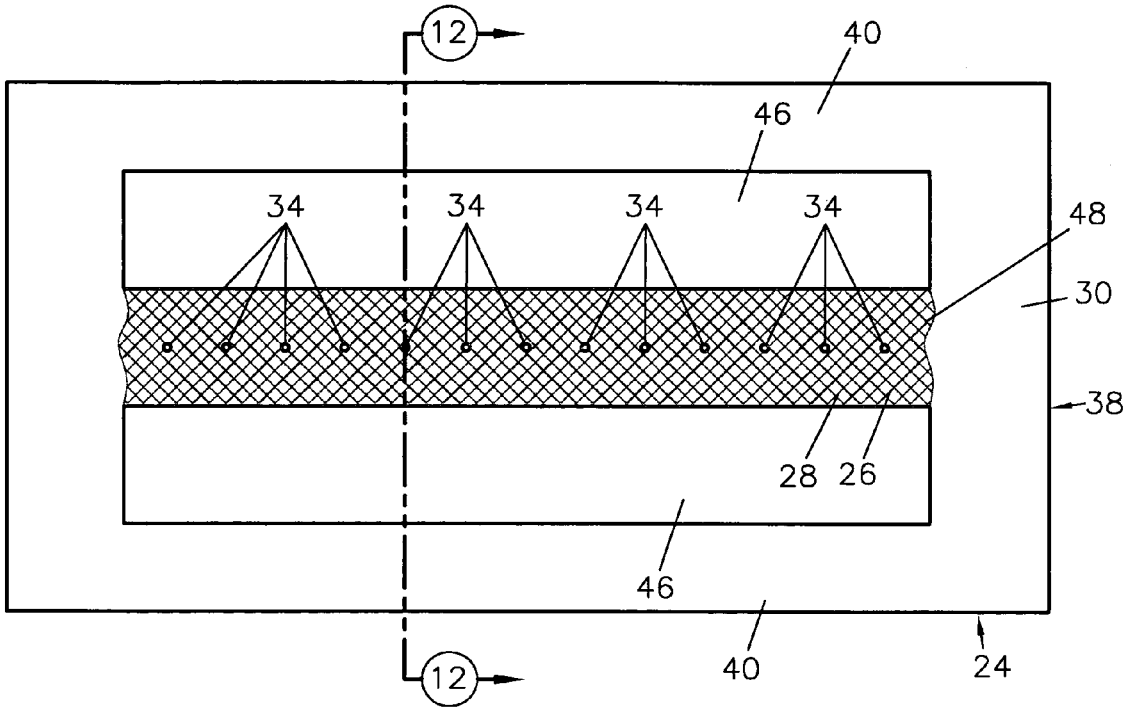
FIG. 11 shows a top plan view of a ninth ion chip of the invention.
Figure 12:
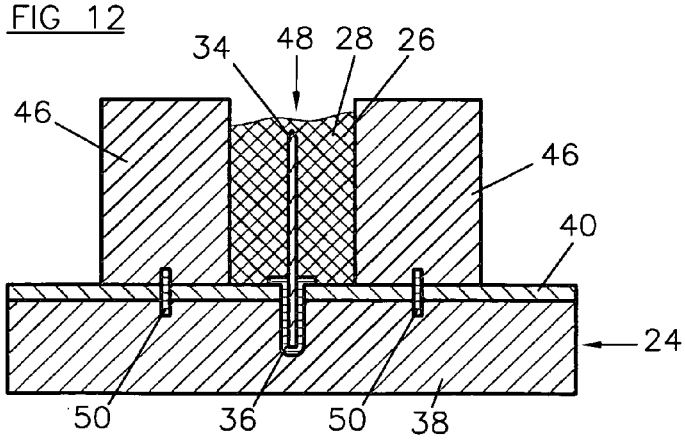
FIG. 12 shows a cross sectional elevational view of the embodiment of FIG. 11.

FIG. 11 shows a top view of ion chip 24, where conductive layer 30 extends over the entire surface of base insulation layer 38 into exposed areas 40. Parallel guide strips 46 (insulated walls) form channel 48, in which lies ionising structure 26, including carbon fiber layer 28 in firm electrical and physical contact directly with conductive layer 30, and indirectly by ionising needles 34. FIG. 12 shows a cross sectional elevational view of this embodiment. Guide strips 46 are attached to base insulation layer 38, by pins 50. Ionising needle 34 is received by metal socket 36, in base insulation layer 38, socket 36 is in physical and electrical contact with conductive layer 30. As shown base insulation layer 38 is approximately 4¼ inch (11 cm) wide by 8¾ inch (20 cm) long, by ¾ inch (2 cm) thick, and is of high dielectric strength to withstand the operating voltage (of the order of 7½ kV), without breakdown or tracking, such materials are well known to those skilled in the art. Guide strips (insulated walls) 46 are of identical material and properties to base insulation layer 38, and are ½ inch (1¼ cm) thick, 1¼ inch (3 cm) tall or deep and 6¾ inch (17 cm) long, channel 48 is about 1¼ inch (3 cm) deep and 1 inch (2½ cm) wide. Ionising structure 26 is held within channel 48, carbon fiber layer 28 extends to about ⅛ inch (3 mm) of the top of the channel, that is it is ambushed or recessed. Optional preferred conventional ionising needles 34 are double ended and about 2½ inch (6½ cm) long extend to the surface of the ambushed carbon fiber layer 28 but not beyond, spaced about ½ inch (1¼ cm) apart along channel 48. Although ionising structure 26 preferably comprises both carbon fiber layer 28 and ionising needles 34, either alone can function as ionising structure 26. In use guide strips 46 contain, support and protect ionising structure 26 and especially carbon fiber layer 28 from contact and damage thereby, as well as maintaining ionising structure 26 in contact with conductive layer 30, while the repulsing electrostatic field of exposed areas 40 of conductive layer 30 focus the negative ion stream. Ideally guide strips 46 are integral with base insulation layer 38, but in practice molding presents practical difficulties.

Figure 13:
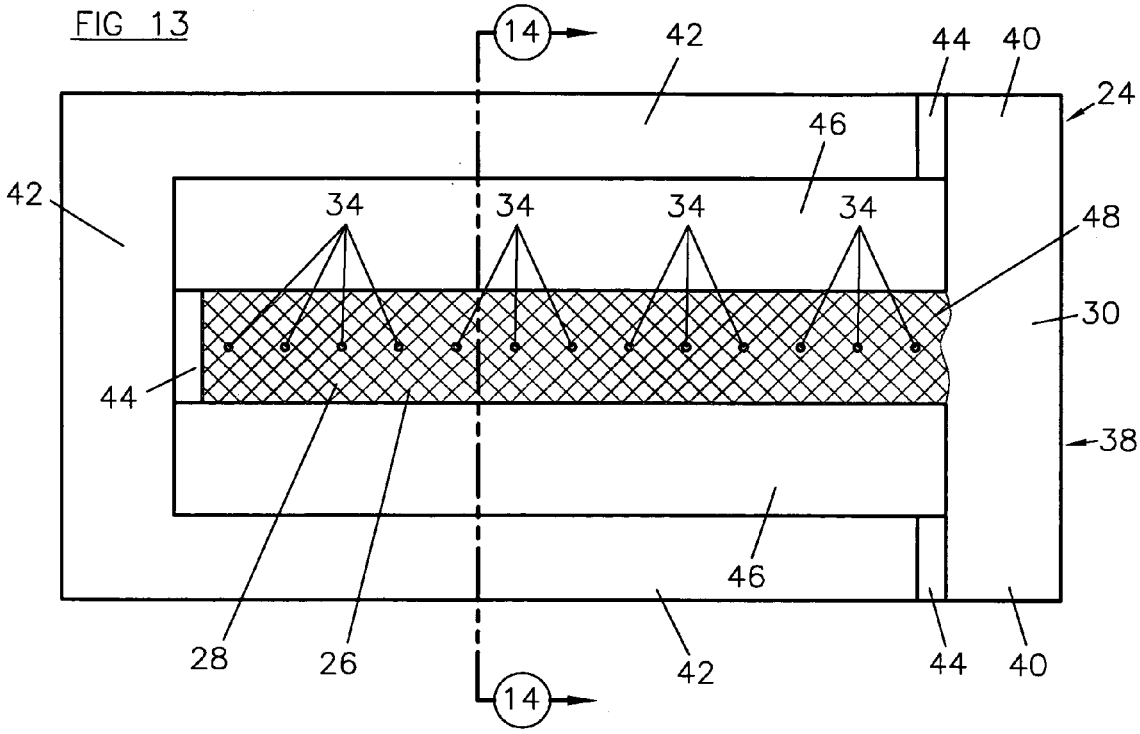
FIG. 13 shows a top plan view of a tenth ion chip of the invention.
Figure 14:
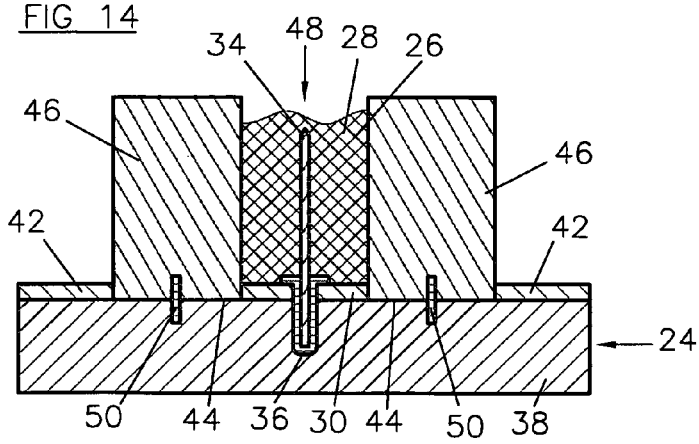
FIG. 14 shows a cross sectional elevational view of the embodiment of FIG. 13.

FIG. 13 shows a top plan view of ion chip 24, base insulation layer 38 has distinct conductive layers 30 and 42 separated by interruption blocks 44. FIG. 14 shows conductive layer 30 extends under ionising structure 26 and supplies electricity to carbon fiber layer 28 and ionising needles 32. Parallel guide strips 46 (insulated walls) form channel 48, in which lies ionising structure 26, including carbon fiber layer 28 in firm electrical and physical contact directly with conductive layer 30, and indirectly by ionising needles 34. Guide strips 46 are attached to base insulation layer 38, by pins 50, interruption blocks 44 run under guide strips 46, so conductive layers 30 and 42 are electrically separate and distinct. Ionising needle 34 is received by metal socket 36, in base insulation layer 38, socket 36 is in physical and electrical contact with conductive layer 30. Conductive layer 42 is preferably operated at a greater negative potential (HV2) than that of conductive layer 30 (HV1), which effectively focusses negative ion flow from ionising structure 26. Conductive layers 30 and 42 together form a negative repulsing electrostatic field which repels and focusses the stream of negative ions perpendicularly away from the surface of ionising structure 26. The general dimensions of FIGS. 13 and 14 are the same as those of FIGS. 11 and 12.

Figure 15:
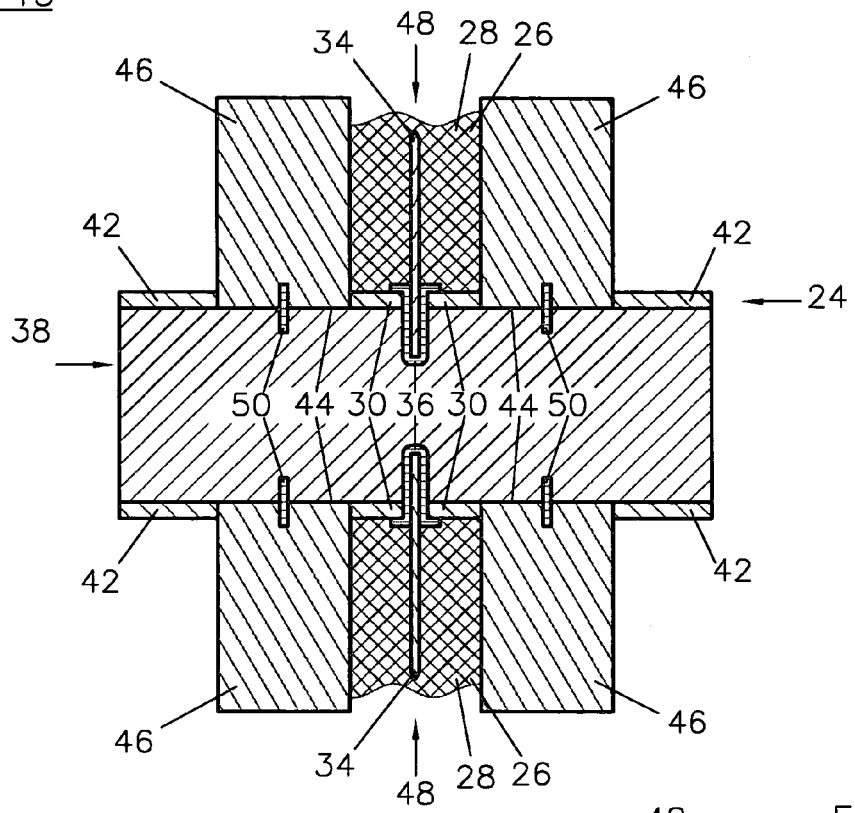
FIG. 15 shows a cross sectional elevational view of an eleventh ion chip of the invention.

FIG. 15 shows a doubled form of the ion chip of FIGS. 13 and 14. Base insulation layer 38 of thickness double that of FIGS. 11 to 14 has distinct conductive layers 30 and 42 separated by interruption blocks 44. Conductive layer 30 underlies ionising structure 26 and supplies electricity to carbon fiber layer 28 and ionising needles 34. Parallel guide strips 46 (insulated walls) form channel 48, in which lies ionising structure 26, including carbon fiber layer 28 in firm electrical and physical contact directly with conductive layer 30, and indirectly by ionising needles 34. Guide strips 46 are attached to base insulation layer 30, by pins 50, interruption blocks 44 run under guide strips 46, so conductive layers 30 and 42 are electrically separate and distinct. Ionising needle 34 is received by metal socket 36, in base insulation layer 38, socket 36 is in physical and electrical contact with conductive layer 30. Conductive layer 42 is preferably operated at a greater negative potential (HV2) than that of conductive layer 30 (HV1), which effectively focusses the negative ion stream from ionising structure 26. Conductive layers 30 and 42 together form a negative repulsing electrostatic field which repels and focusses the stream of negative ions perpendicularly away from the surface of ionising structure 26. Both faces of ion chip 24 of FIG. 15 are similar to FIG. 14. The general dimensions of FIG. 15 are the same as those of FIGS. 11 to 14. In use one face is operational, that is connected to a high negative voltage generator, until its ionising electrodes are exhausted, then it is turned over and the other face is operational until its ionising electrodes are exhausted. The exhausted carbon fibers 28 and ionising needles 34 can be replaced while the other face is operational.

Figure 16:
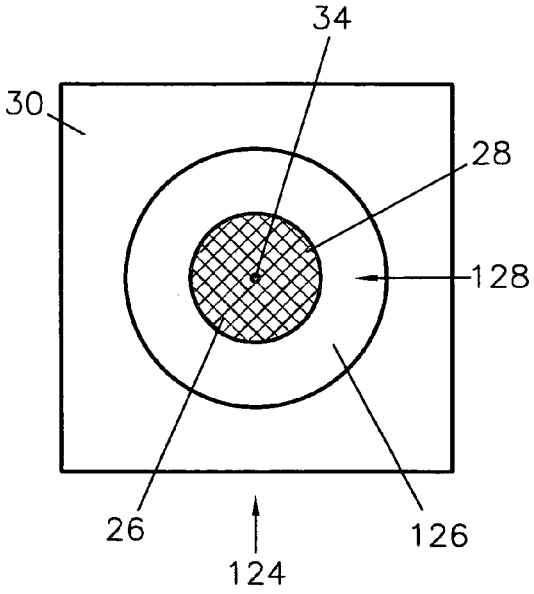
FIG. 16 shoes a top plan view of a twelfth ion chip of the invention.
Figure 17:
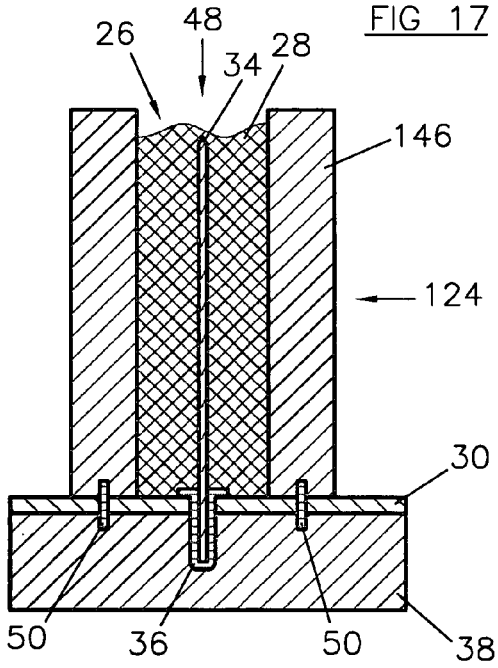
FIG. 17 shows a cross sectional elevational view of the embodiment of FIG. 16.
Figure 22:
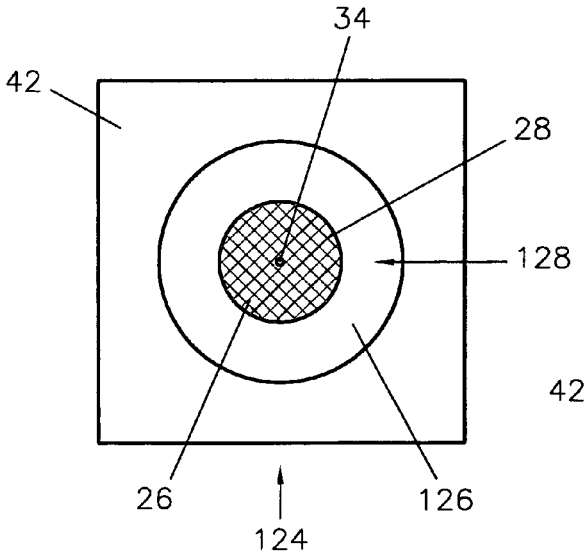
FIG. 22 shoes a top plan view of a thirteenth ion chip of the invention.
Figure 23:
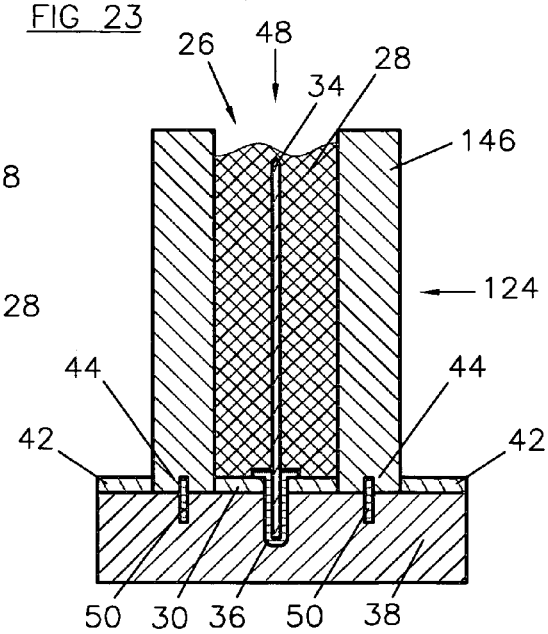
FIG. 23 shows a cross sectional elevational view of the embodiment of FIG. 22.

FIGS. 16 and 17 show tubular ion chip 124, with base insulation layer 38, in this case ¾ inch (2 cm) thick, topped by conductive layer 30, and tubular wall 146 has channel 148, containing chopped packed segments (brush stubs) of conductive carbon fiber strand or yarn 28 forming ionising structure 26, which is ambushed (recessed) about ⅛ inch (3 mm). Tubular wall 146 is 3 inch (7½ cm) deep, ½ inch (1¼ cm) thick, with internal diameter 1 inch (2½ cm). Ionising needle (pin) 34 engages metal socket 36 in base insulation layer 38, metal socket 36 is firm physical and electric contact with conductive layer 30. Pins 50 attach tubular wall 146 to base insulation layer 38. The chopped stubs, like brush ends, provide more thread end electrodes per unit area than unchopped carbon fiber yarn. FIGS. 22 and 23 show tubular ion chip 124, otherwise identical to the ion chip of FIGS. 16 and 17, with base insulation layer 38, outside tubular wall 146, toped by conductive layer 42, separated from conductive layer 30 by interruption block 44 under tubular wall 146. Tubular ion chips 124 can be used instead of ion chips 24 of FIGS. 11 to 14, in virtually any application.

Although channel 48 and ionising structure 26 are shown as about 6¾ inch (17 cm) long, they can be extended to about 5 foot (1½ m) long, without disadvantage. Other dimensions given such as width and depth of ionising structure 26, base insulation layer 38, guide strips 46 and channel 48 can be varied, and should be viewed as practical guides.

Figure 18:
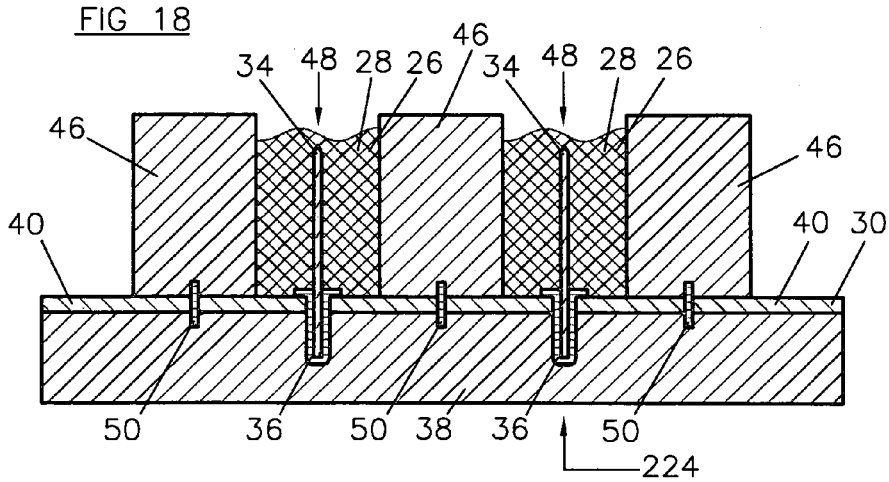
FIGS. 18 to 21 show cross sectional elevational views of different of ion chip combinations.
Figure 19:
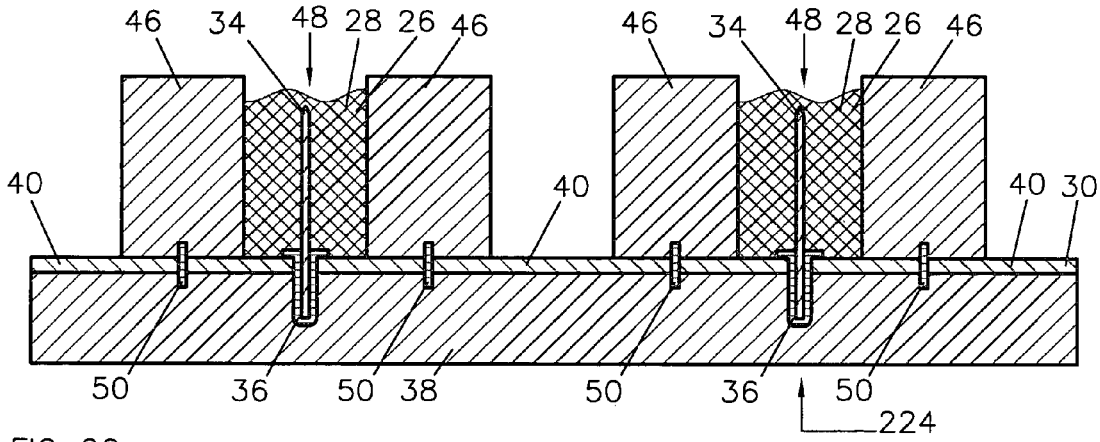
Figure 20:
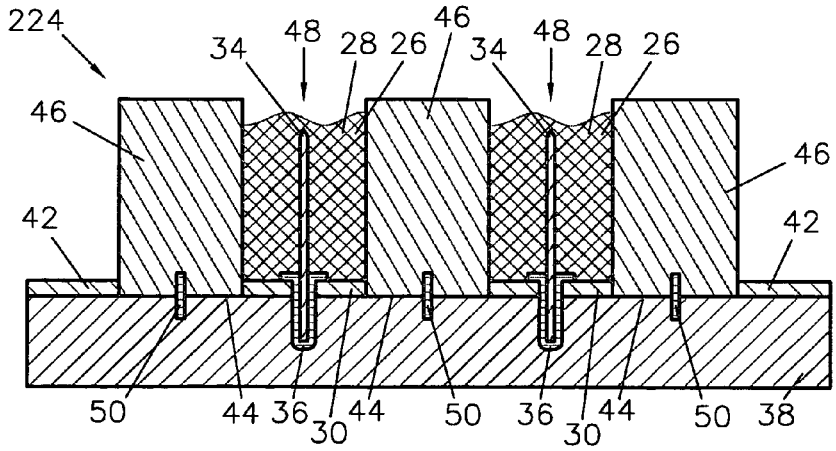
Figure 21:
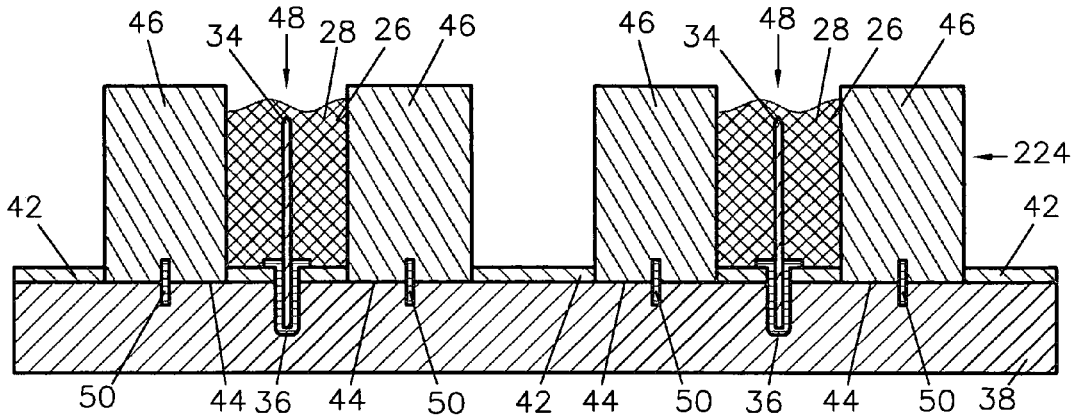

FIG. 18 shows ion chip 224 with two channels 48 side by side with a common guide strip 46 both channels 48 have ionising structure 26 including carbon fiber layer 28, ionising needles 34 seated in metal sockets 36 in base insulation layer 38, and guide strips 46 secured by pins 50. Conductive layer 30 on base insulation layer 38 is continuous with exposed areas 40 acting as focussing elements. Both ionising structures 26 operating together generate a concentrated negative ion stream. FIG. 19 shows ion chip 224 with two channels 48 side by side with an exposed area 40 of conductive layer 30 separating them, both channels 48 have ionising structure 26, including carbon fiber layer 28 and ionising needles 34 seated in metal sockets 36, and guide strips 46 secured by pins 50. Conductive layer 30 on base insulation layer 38 is continuous with exposed areas 40 acting as focussing elements. Both ionising structures 26 operating together generate a distributed negative ion stream. In both FIGS. 18 and 19 the separate ionising structures 26 operate independently in electrical parallel as the voltage is supplied to conductive layer 30. FIG. 20 shows ion chip 224 with two channels 48 side by side with a common guide strip 46 both channels have ionising structure 26, including carbon fiber layer 28 and ionising needles 34 seated in metal sockets 36 in base insulation layer 38, and guide strips 46 secured by pins 50. Conductive layer 30 on base insulation layer 38 underlies ionising layers 26. Both ionising layers 26 operating together generate a concentrated negative ion stream. Separated from conductive layer 30 by interruption blocks 44, shown as under outer guide strips 46, is distinct conductive layer 42 acting as focussing elements, especially when 42 is at higher negative potential. FIG. 21 shows ion chip 224 with two channels 28 side by side with distinct conductive layer 42 separating them, both channels have ionising structure 26, including carbon fiber layer 28, ionising needles 34 seated in metal sockets 32 seated in base insulation layer 38 and guide strips 46 secured by pins 50. Conductive layer 30 on base insulation layer 38 underlies ionising structure 26. Separated from conductive layer 30 by interruption blocks 44, shown as under guide strips 46, is distinct conductive layer 42 acting as focussing elements, especially when 42 is at higher negative potential. Both ionising structures 26 operating together generate a distributed negative ion stream. In both FIGS. 20 and 21 the separate ionising structure 26 operate in electrical parallel as the voltage is supplied to conductive layer 30. Guide strips 46 contain, support and allow recessing (ambushing) of ionising structure 26 in each channel 48. Each ionising structure 26, including carbon fiber layer 28 is in separate electrical and physical contact with conductive layer 30 thus each ionising structure 26 will function, emitting negative ions as determined by its operating electrodes separately from neighboring ionising structures 26 although having a common operating electrical supply. These ion chips 224 can be extended for example multiple channels 48 can be present with common guide strips 46 and a single conductive layer 28 as in FIG. 18, or multiple channels 48 each separated by exposed areas 40 of common conductive layer 30 as in FIG. 19. Alternatively multiple channels 48 can be present with common guide strips 46 supplied by a single conductive layer 30, with outer exposed areas of distinct conductive layer 42, as in FIG. 20, or multiple channels 48 each supplied by conductive layer 30 separated by exposed areas of distinct conductive layer 42 as in FIG. 21. Larger ion chips may contain mixtures or combinations of these arrangements. These larger ion chips are designed to provide specific negative ion streams suitable for specific situations including greater output, and multiple streams of negative ions focussed as desired.

In all the embodiments illustrated above carbon fiber layers 28 and ionising needles 34 can be removed when exhausted and replaced by new carbon fiber layers 28 and ionising needles 34.

The ion chips are designed to operate with the lesser negative voltage which generates ozone at acceptable levels (preferably none). By connecting the system to a suitable higher negative voltage the ion chip can actively generate ozone as a fumigating agent, for treating air borne bacteria such as pathogenic microbes, in the absence of humans and livestock.

As those skilled in the art would realize these preferred described details and materials and components can be subjected to substantial variation, modification, change, alteration, and substitution without affecting or modifying the function of the described embodiments.

Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. Ion chip comprising an ionising structure having a plurality of corona forming ionising electrodes, in electrical and physical contact with the surface of a metal conductor said ionising structure being selected from the group consisting of conductive fibers, ionising needles and mixtures thereof whereby when sufficient high voltage is applied to said conductor by a high voltage generator said ionising structure generates ions, said metal conductor is a bare uninsulated wire and lies in a channel having opposed insulating side walls and an insulating back wall and said conductor lies along said back wall of said channel and extends from side wall to side wall, said metal conductor providing surface to surface electrical contact to said ionising structure over the entire area of contact between said structure and said surface of said conductor, said conductor additionally providing an electrostatic repulsing field to direct said ions into a stream, generally perpendicular to said conductor and said high voltage generator is an electronic ion generator comprising a printed circuit board housed in a strong insulated box, with a uni-polar negative output, with full wave rectification and a miniature step-up instrument transformer of limited short circuit capacity to ensure minimum ignition energy cold sparking under fault and limited threshold CD value of about 7 kV to ensure limited ozone considerably within the EDA recommendation of 50 parts per billion.

2. Ion chip of claim 1, wherein said ionising structure is conductive carbon fibers, which extend forward away from said conductor and said back wall, filling the space between said side walls, said conductive carbon fibers being recessed within said channel.

3. Ion chip of claim 2, wherein said channel is circular and said conductor is a ring conductor.

4. Ion chip comprising a planar conductive surface having directly attached thereto an ionising structure generally perpendicular to said planar conductive surface, having a plurality of corona forming ionising electrodes, in electrical and physical contact with said conductive surface, whereby when sufficient high voltage is applied to said conductive surface by a high voltage generator said ionising structure generates ions, the base of said ionising structure being in surface to surface electrical contact with said conductive surface over the entire base area of said structure, said conductive surface additionally providing an electrostatic repulsing field to direct said ions into a stream generally perpendicular to said planar conductive surface and said high voltage generator is an electronic ion generator comprising a printed circuit board housed in a strong insulated box, with a uni-polar negative output, with full wave rectification and a miniature step-up instrument transformer of limited short circuit capacity to ensure minimum ignition energy cold sparking under fault and limited threshold CD value of about 7 kV to ensure limited ozone considerable within the EDA recommendation of 50 parts per billion.

5. Ion chip of claim 4, wherein said ionising structure is selected from the group consisting conductive carbon fibers, ionising needles and mixtures thereof, and said conductive surface is metal.

6. Ion chip of claim 5, wherein said ionising structure is conductive carbon fibers.

7. Ion chip of claim 6, wherein said conductive carbon fibers are supported by pins attached to said metal surface.

8. Ion chip of claim 6, wherein said ionising structure additionally comprises ionising needles received in said metal surface in metal sockets.

9. Ion chip of claim 5, wherein said ionising structure comprises ionising needles received in said metal surface in metal sockets.

10. Ion chip comprising a conductive layer on a base insulation layer, said conductive layer comprising a planar conductive surface having directly attached thereto an ionising structure generally perpendicular to said planar conductive surface, having a plurality of corona forming ionising electrodes, in electrical and physical contact with said conductive surface, whereby when sufficient high voltage is applied to said conductor by a high voltage generator said ionising structure generates ions, the base of said ionising structure being in surface to surface electrical contact with said conductive surface over the entire base area of said structure, said conductive surface additionally providing an electrostatic repulsing field to direct said ions into a stream generally perpendicular to said planar conductive surface and said high voltage generator is an electronic ion generator comprising a printed circuit board housed in a strong insulated box, with a uni-polar negative output, with full wave rectification and a miniature step-up instrument transformer of limited short circuit capacity to ensure minimum ignition energy cold sparking under fault and limited threshold CD value of about 7 kV to ensure limited ozone considerably within the EDA recommendation of 50 parts per billion.

11. Ion chip of claim 10, wherein said ionising structure is selected from the group consisting conductive carbon fibers, ionising needles and mixtures thereof, and said conductive layer is metal.

12. Ion chip of claim 11, wherein said ionising structure is conductive carbon fibers, and said metal layer is a printed circuit.

13. Ion chip of claim 12, wherein said ionising structure additionally comprises ionising needles received in said metal surface in metal sockets embedded in said base insulation layer.

14. Ion chip of claim 11, wherein said ionising structure comprises ionising needles received in said metal surface in metal sockets embedded in said base insulation layer, and said metal layer is a printed circuit.

15. Ion chip of claim 13, wherein said metal layer and said base insulation layer extend beyond the ionising structure.

16. Ion chip of claim 15 wherein said ionising structure extends along a channel between paired opposed parallel insulating guide strips, the ionising structure is recessed within said channel, and said metal layer extends outside said channel on said base insulation layer.

17. Ion chip of claim 13, wherein a first conductive metal layer is in contact with said ionising structure, said base insulation layer extends beyond said ionising structure and said first metal layer, and a second metal conductive layer at least partly surrounds said first metal layer and said second conductive metal layer is separated from contact with said first metal layer and said ionising structure by interruption blocks on the surface of said base insulation layer.

18. Ion chip of claim 17 wherein said ionising structure extends along a channel between paired opposed parallel insulating guide strips, the ionising structure is recessed within said channel, and said first metal layer extends inside said channel on said base insulation layer, and said second metal layer extends outside said channel on said base insulation layer, and said second conductive metal layer is separated from contact with said first metal layer and said ionising structure by interruption blocks on the surface of said base insulation layer.

19. Ion chip of claim 12, wherein said ionising structure additionally comprises at least one ionising needle received in said metal surface in a metal socket embedded in said base insulation layer, wherein said metal layer and said base insulation layer extend beyond the ionising structure, and said ionising structure is confined within an insulating tubular wall.

20. Ion chip of claim 12, wherein said ionising structure additionally comprises at least one ionising needle received in said metal surface in a metal socket embedded in said base insulation layer, said ionising structure is confined within an insulating tubular wall, and a first conductive metal layer is in contact with said ionising structure, said base insulation layer extends beyond said ionising structure and said first metal layer, and a second metal conductive layer at least partly surrounds said first metal layer and said second conductive metal layer is separated from contact with said first metal layer and said ionising structure by interruption blocks on the surface of said base insulation layer.

* * * * *